US009540864B2

(12) United States Patent
Mader et al.

(10) Patent No.: US 9,540,864 B2
(45) Date of Patent: Jan. 10, 2017

(54) METHOD AND APPARATUS FOR CHANGING SPACERS

(71) Applicant: LISEC AUSTRIA GMBH, Seitenstetten (AT)

(72) Inventors: Leopold Mader, Neuhofen/Ybbs (AT); Leopold Karner, Krummnussbaum (AT)

(73) Assignee: LISEC AUSTRIA GMBH, Seitenstetten (AT)

( * ) Notice: Subject to any disclaimer, the term of this patent is extended or adjusted under 35 U.S.C. 154(b) by 148 days.

(21) Appl. No.: 14/395,571

(22) PCT Filed: Oct. 8, 2013

(86) PCT No.: PCT/AT2013/000163
§ 371 (c)(1),
(2) Date: Oct. 20, 2014

(87) PCT Pub. No.: WO2014/063173
PCT Pub. Date: May 1, 2014

(65) Prior Publication Data

US 2015/0074968 A1 Mar. 19, 2015

(30) Foreign Application Priority Data

Oct. 22, 2012 (AT) ..... A 1137/2012

(51) Int. Cl.
*E06B 3/673* (2006.01)

(52) U.S. Cl.
CPC ..... *E06B 3/67326* (2013.01); *E06B 3/6733* (2013.01); *E06B 3/67365* (2013.01); *Y10T 29/49817* (2015.01); *Y10T 29/53978* (2015.01)

(58) Field of Classification Search
CPC E06B 3/67326; E06B 3/67365; E06B 3/6733; Y10T 29/49817; Y10T 29/53978
See application file for complete search history.

(56) References Cited

U.S. PATENT DOCUMENTS 7,008,492 B2 3/2006 Lisec
7,523,776 B2 4/2009 Lisec
(Continued)

FOREIGN PATENT DOCUMENTS

AT 9 595 U 12/2007
DE 10 212 359 10/2003
(Continued)

OTHER PUBLICATIONS

International Search Report dated Feb. 5, 2014, corresponding to PCT/AT2013/000163.

*Primary Examiner* — John C Hong
(74) *Attorney, Agent, or Firm* — Young & Thompson

(57) ABSTRACT

A method and apparatus for the, preferably automated, changing of spacers in a plant having at least one applicator head for applying spacers to panel-shaped workpieces, in particular glass panes. Spacers from at least two sources are fed to the applicator head in an offset manner with respect to one another. A first spacer from a first source is separated. The resulting end of the first spacer and a start of the second spacer, which comes from a second source, are moved into a mutually assigned position by a changing device. Then, the end of the first spacer is connected to the start of the second spacer. A resulting connection of the first spacer with the second spacer runs through the plant until the connection has passed the applicator head. Thereafter, the second spacer is separated in a region between the connection and the applicator head.

19 Claims, 3 Drawing Sheets

(56) References Cited

U.S. PATENT DOCUMENTS

| | | | | |
|---|---|---|---|---|
| 8,964,611 | B2 * | 2/2015 | Das | H04W 52/0229 370/311 |
| 9,103,162 | B2 * | 8/2015 | Mader | E06B 3/6733 |
| 2003/0178127 | A1 | 9/2003 | Lisec | |
| 2005/0247392 | A1 | 11/2005 | Lisec | |
| 2006/0076110 | A1 | 4/2006 | Lisec | |
| 2011/0154635 | A1 | 6/2011 | Wunnicke et al. | |
| 2012/0180936 | A1 | 7/2012 | Schuler | |

FOREIGN PATENT DOCUMENTS

| | | |
|---|---|---|
| DE | 10 350 312 | 6/2005 |
| DE | 202006014938 | 12/2006 |
| DE | 10 2009 035 002 | 1/2011 |
| WO | 2011/047402 | 4/2011 |
| WO | 2011/047938 | 4/2011 |

* cited by examiner

METHOD AND APPARATUS FOR CHANGING SPACERS

BACKGROUND OF THE INVENTION

Field of the Invention

The invention relates to a method for changing spacers in a unit with at least one applicator head for application of spacers to sheet-shaped workpieces, especially panes of glass.

The invention furthermore relates to an apparatus for changing spacers in a unit with at least one applicator head for application of spacers to sheet-shaped workpieces, especially panes of glass.

Description of the Related Art

Spacers that are applied to sheet-shaped workpieces are used in particular in the production of insulating glass. In this case, the workpieces are panes of glass.

In addition to spacers that consist of metal sections, plastic spacers are also known that are flexible and that are applied to panes of glass using applicator devices.

Pertinent methods and apparatuses for the application of spacers are known from AT 11 889 U, AT 9 595 U, DE 10 212 359 A, DE 10 350 312 A, DE 10 2009 035 002 A, DE 2020 006 14 938 U, US 2011/154635 A and WO 2011/047402 A.

If the formats of the sheet-shaped workpieces, for example the type of insulating glass, change, the problem arises that it becomes necessary to change from one type of spacer to another type. Here, a change is generally defined as the change between spacers of a different type and/or from different sources. Here, it can be, for example, spacers of the same type but with different width, spacers of the same thickness of different type or else completely identical spacers that are withdrawn from different (supply) spools, for example if the spacer from one (supply) spool is coming to the end.

In doing so, it should be avoided that spacers from different sources are applied to the same workpiece, since even for identical spacers, the junction (connection) between the spacers constitutes a potential leakage site; this is disadvantageous in, for example, insulating glass.

In the past, a change of spacers required many steps to be carried out by hand, for example the removal of the existing spacer and the "threading" of the new spacer into the unit. This is mainly very personnel-intensive and time-consuming.

BRIEF SUMMARY OF THE INVENTION

The object of the invention is to devise a method and an apparatus for changing spacers that allow changing of spacers that is efficient in terms of time and money.

The object is achieved according to the invention with a method.

The invention is also implemented with a device.

Preferred and advantageous configurations of the method and of the apparatus according to the invention are the subject matter of the dependent claims.

One advantage of the invention is that the changing of spacers can take place partially or completely automatically.

Spacers from at least two different sources are supplied to the applicator head staggered in time to one another. In this case, the different sources can be both different (supply) spools, for example in one climate-controlled cabinet, and also in several climate-controlled cabinets, or the like. The climate-controlled cabinets are used to maintain conditions that are especially favorable for spacers. Their operation and their structure are known from the state of the art.

For changing spacers, first of all the first or "old" spacer that is currently located in the unit or in the applicator head and that is removed from a first source is severed near the first source. In doing so, one end of the first spacer is formed. The latter can preferably be held by a holder that is intended for this purpose. A start of a second or "new" spacer is located in the vicinity of the end of the first spacer. The start of the second spacer can likewise be held by a holder that is intended for this purpose. The start of the second spacer and the end of the first spacer are then caused to approach one another, for example by the holders approaching one another, preferably until the start and end at least touch. Then, a connection is established between the end of the spacers and the start of the spacers. This can take place preferably by cementing, pressing, clamping or similar methods.

If the first spacer continues to be conveyed, the resulting connection between the first and the second spacer passes through the unit until the connection has passed the applicator head. The first (old) spacer therefore continues to move through the unit and in doing so entrains the second (new) spacer via the connection through the unit. This thus eliminates time-consuming threading of the second (new) spacer.

After the connection between the first and the second spacer has passed the applicator head, the second spacer is severed in a region between the connection and the applicator head. Subsequently, the second (new) spacer is in the applicator head, and the region of the connection has been removed from the production and application process.

Especially preferably, the first spacer is severed after a first removal unit that removes the first spacer of the first source. The removal unit comprises devices that are necessary for the removal of a spacer from the source. The removal unit can withdraw the spacer from, for example, a (supply) spool and prepare it for further use by, for example, a protective film being removed from the spacer. The removal unit can also contain still further elements that are known from the state of the art.

In another preferred embodiment of the method, the second spacer is severed after the connection between the first and second spacers has emerged from the applicator head on the delivery side. Thus, the applicator head after severing is again ready to apply the second (new) spacer to a workpiece. Especially preferably, when the second spacer is severed, the distance between the connection and the applicator head is kept as small as possible. Thus, less scrap is formed.

According to one quite especially preferred embodiment of the method of the invention, when different spacers are to be applied to two successive workpieces, the required length of the first spacer that is to be applied is computed based on the dimensions of the first workpiece (more than only one workpiece can also be taken into account) and the first spacer is severed on or after the computed end and is connected to the second spacer. This avoids an uneconomically large amount of the first spacer from passing through the unit only in order to draw the second spacer through the unit. Thus, changing the spacers is undertaken with regard to the future. Thus, only one short piece of first and second spacers at a time arises upstream and downstream from the connection, which spacers cannot be used.

Therefore, in the invention, it is possible to carry out the changing of spacers at any time. The time is, however, preferably chosen such that scrap (and thus residues to be disposed of) is formed to the smallest degree possible.

Within the scope of the invention, the use of spacers that consist of plastic and are flexible and into which a desiccant is embedded is considered.

BRIEF DESCRIPTION OF THE DRAWINGS

Other details and features of the invention will become apparent from the following description of one possible embodiment of the method and one embodiment for an apparatus according to the invention using the drawings. Here.

DETAILED DESCRIPTION OF THE PREFERRED EMBODIMENTS

The unit that is shown schematically in FIG. 1, aside from the details described below, can be designed as is known from the state of the art.

Figure 1:
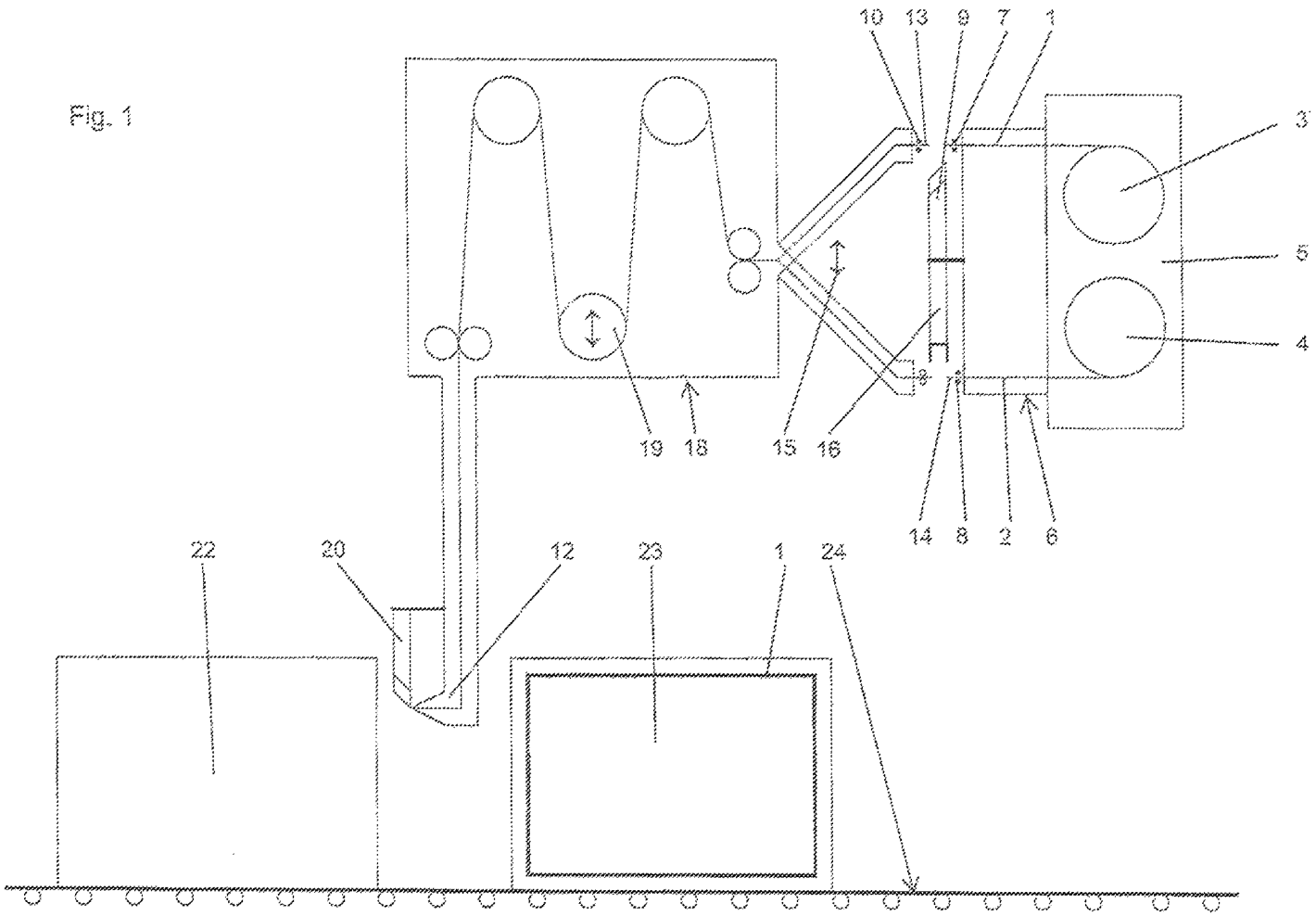
FIG. 1 shows a schematic of a unit for applying spacers with an apparatus according to the invention.

FIG. 1 shows a unit for applying spacers with an apparatus according to the invention. A first spacer 1 and a second spacer 2 are held in readiness on (supply) spools 3 and 4 in a climate-controlled cabinet 5.

The climate-controlled cabinet 5 is made as is known from the state of the art and maintains ambient conditions that are favorable for the further processing of the spacers 1 and 2, such as, for example, temperature and/or atmospheric humidity. The apparatus according to the invention can have several climate-controlled cabinets.

The spacers 1 and 2 travel from the climate-controlled cabinet 5 into a removal device 6. The removal device 6 that is connected downstream from the climate-controlled cabinet 5 can contain, among others, an arrangement for suction of protective films off spacers 1 and 2 that generally consist of elastic plastic, a sag control for uniform removal of the spacers 1 and 2, and devices for removing and conveying the spacers 1 and 2 in each case (not shown).

In addition to the indicated elements, the removal device 6 has removal-clamping devices 7 and 8 with which the spacers 1 and 2 can be held in a defined position. Aside from the aforementioned changes, the removal device 6 can be made as is known from the state of the art.

In the illustrated embodiment, spacers 1 and 2 are removed via the same removal device 6. Embodiments with more than one removal device 6 are likewise considered within the scope of the invention.

On the delivery side of the removal device 6, there is a separating means 9, with which the spacers 1 and 2 can be severed. The illustrated embodiment shows the first spacer 1 in severed form. The end 13 of the first spacer 1 that is assigned to an applicator head 12 is held in a changing-clamping device 10. The other end of the first spacer 1, which end is located in the removal device 6, is held by the first removal-clamping device 7.

The end 13 of the first spacer 1 can be moved with the changing-clamping device 10 to a start 14 of the second spacer 2, which is held by the removal-clamping device 8, as is indicated by an arrow 15. After the end 13 (as indicated by the broken line) has been brought into the vicinity of the start 14, the start 14 and end 13 are connected to one another using an apparatus 16 to form a connection 11. The apparatus 16 for joining can join the start 14 and the end 13 to one another, for example by cementing, pressing and/or clamping.

Figure 2:
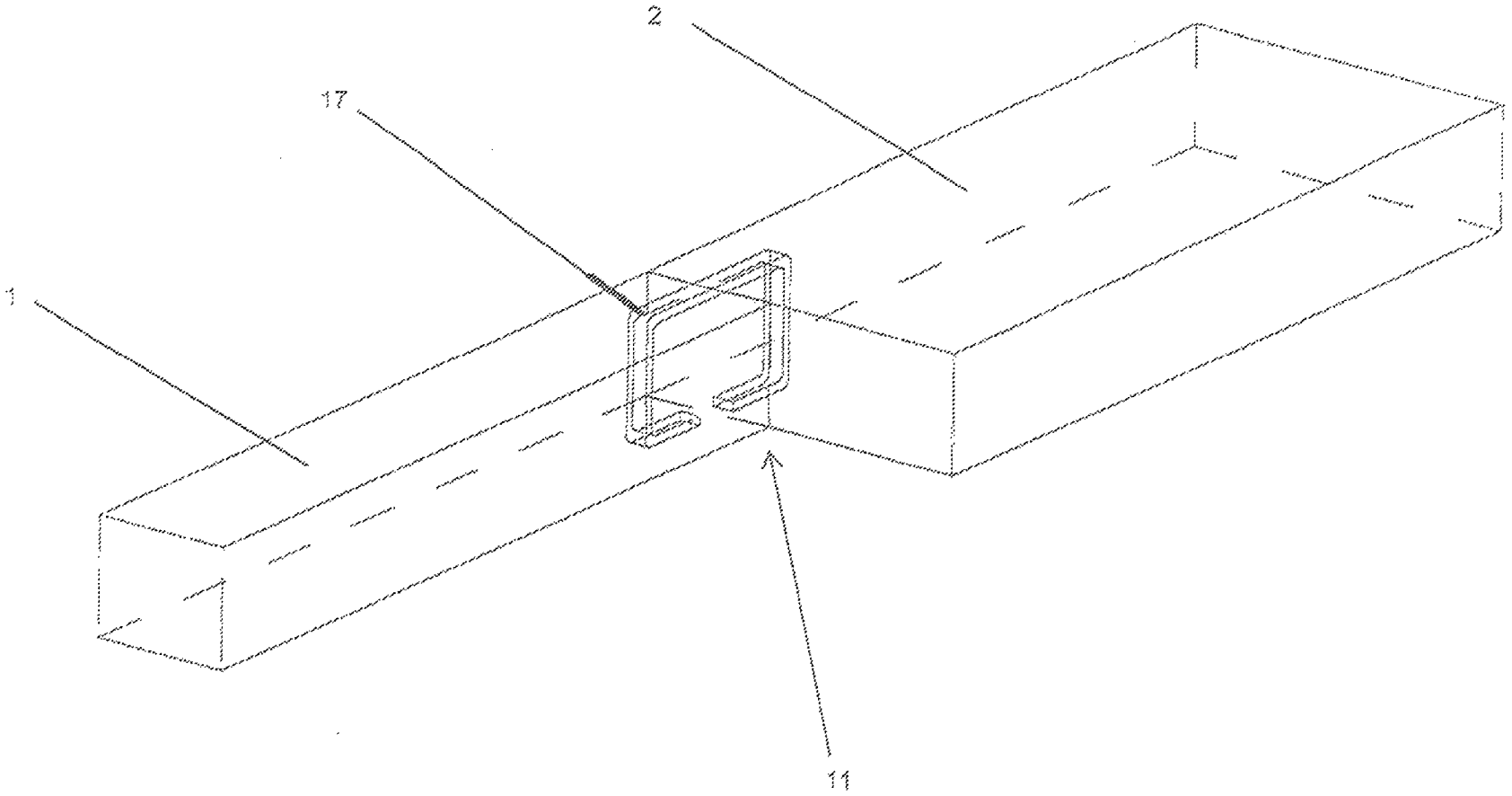
FIG. 2 shows a connection of two different spacers by way of example.

By way of example, FIG. 2 shows one embodiment of the connection 11 between the first spacer 1 and the second spacer 2 by means of a clamp 17.

After the connection 11 has been established, the spacers 1 and 2 pass in succession through a feed 18 that supplies the spacers 1 and 2 to the applicator head 12.

In the illustrated embodiment, the feed 18 has a dancer roll 19. Such an embodiment is advantageous even if during the changing and joining of spacers 1 and 2, the application of spacers is not to be interrupted. While the removal is interrupted for the changing from spacer 1 to spacer 2, in the continued application a length of the spacer 1 and 2 that is stored by way of the dancer roll 19 in the feed 18 is used up. Embodiments in which there are no dancer rolls 19 or the like, such as, for example, another sag control, are likewise conceivable. Thus, for example, the application can be interrupted during the changing from spacer 1 to spacer 2.

The spacers 1 and 2 travel from the feed 18 in succession into the applicator head 12. The latter applies the spacers 1 or 2 to the workpiece 22, 23, for example a pane of glass that is conveyed via a conveyor apparatus 24 into the applicator unit and again out of the latter. After application, another separating means 20 separates the applied spacer 1 or 2 from the spacer 1 or 2 that is still located in the applicator head 12. This separation takes place preferably immediately after the applicator head 12.

Figure 3:
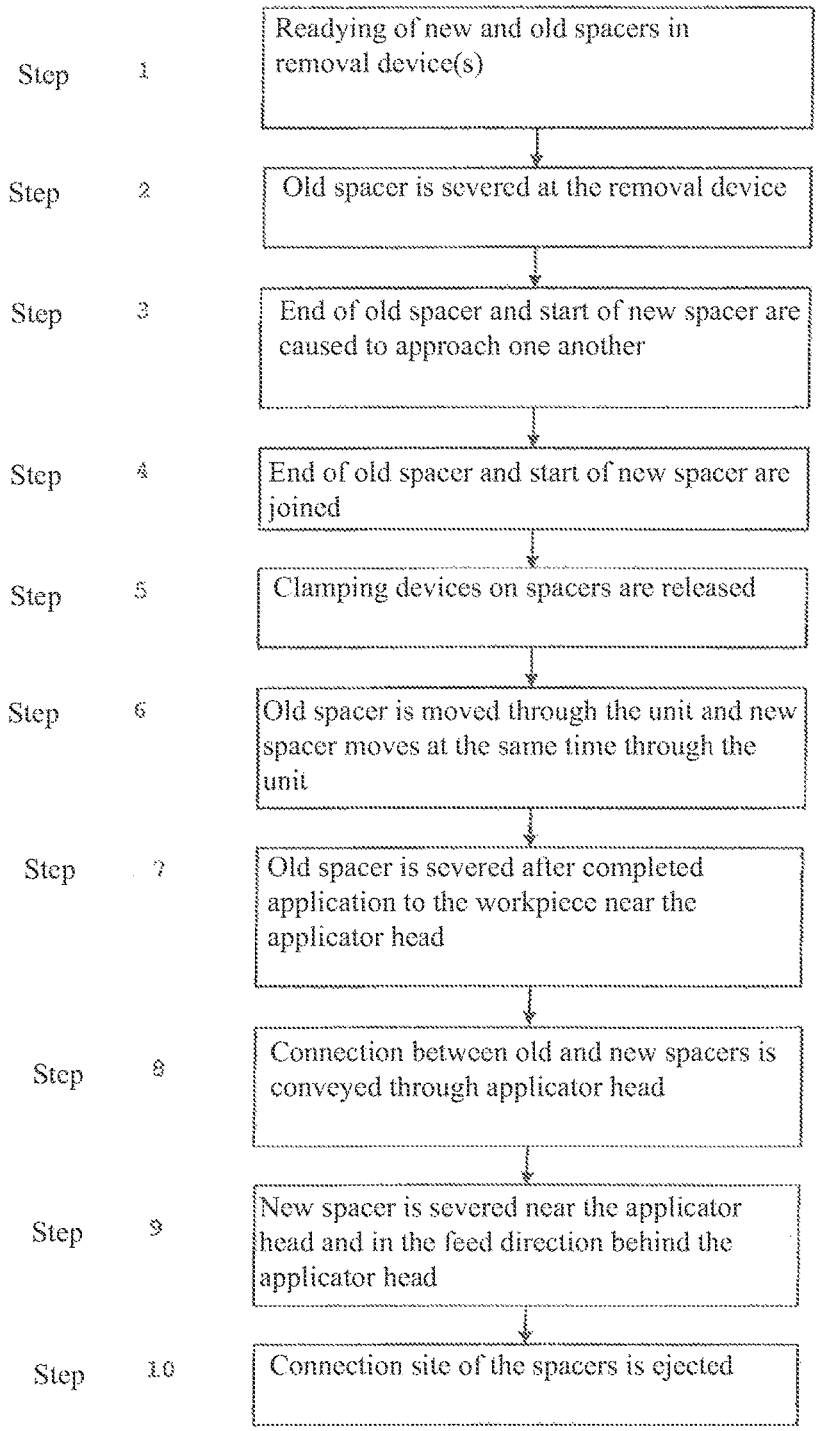
FIG. 3 shows a flow chart with an embodiment of the method by way of example.

Altogether, the manner of operation according to the invention in an exemplary process sequence (FIG. 3) can be summarized as follows:

Using an applicator head 12, a flexible spacer 1 or 2 (also called "spacer") is applied to a workpiece 22, 23, such as, for example, a pane of glass, which is located in an applicator unit, along the edge of the workpiece 22, 23 (offset to the inside relative to the edge).

In each case, the one of the spacers 1 and 2 that is already located at the exit end of the applicator head 12 is severed for completion of an application of the spacer 1 or 2 to a workpiece 22, 23 so that a new, free end of the spacer 1 or 2 is ready for the application.

The inventive changing from the first spacer 1 to the second spacer 2 takes place as in the steps 1 to 10 that are indicated below.

While these steps are being executed, the application process can be interrupted. It is also possible, however, to store in the unit enough spacers 1 and 2 for the time that is necessary for changing, for example by way of a dancer roll 19, and only to interrupt the removal of spacers 1 and 2 from a storage unit, for example a supply spool 3, 4.

This can take place in any phase of spacer application. The instant at which the changing from the first spacer 1 to the second spacer 2 is carried out is preferably chosen using future-oriented production planning such that as little scrap (spacer residue) as possible forms. The instant of changing is preferably chosen such that the spacer 1 or 2 that is located at this instant in the spacer feed 18 between the applicator head 12 and removal device 6 is used as completely as possible, and therefore can be applied to a workpiece 22, 23 in order to minimize the amount of scrap that forms. The spacer feed 18 between the applicator head 12 and the removal device 6 picks up a spacer strand of a length that corresponds to, for example, the circumference of a workpiece or a few workpieces, such as panes of glass.

Generally, the length of the spacer 1 or 2 that is located in the spacer feed 18 does not correspond to an integral multiple of the circumference of the workpiece 22, 23, for example panes of glass, plus the length of a comparatively short piece of scrap, so that the changing takes place in most cases at an instant at which the application of spacers 1 and 2 to a workpiece 22, 23 takes place and not at an instant at which the application of the spacers 1 and 2 to a workpiece 22, 23 is already completed and the application of spacers 1 and 2 to a workpiece to be processed subsequently has not yet been started. If a dancer roll 19 stores an additional length of spacer 1 or 2 in the unit or the feed 18, the latter is also included in computations for optimization of the length.

Changing from a first spacer 1 to a second spacer 2 can take place in the following steps:

Step 1: In the removal device 6, spacers 1 and 2 are prepared by their being held in a defined position by removal-clamping devices 7 and 8.

Step 2: The first spacer 1 that is in use at the start of changing (old spacer) is separated on the exit side end of the removal device 6 by the separating means 9, for example separating shears provided on the changing unit, being actuated. The changing-clamping device 10 retains the feed-side end 13 of the first spacer 1, which end is formed after severing.

Step 3: The free ends 13 and 14 of the spacers 1 and 2 that are to be joined to one another are caused to approach one another by the changing-clamping device 10 with the end 13 of the first spacer 1 being moved toward the second removal-clamping device 8, which holds the start 14 of the second spacer 2.

Step 4: The end 13 of the first spacer 1 and the start 14 of the second spacer 2 are pressed onto one another, and using a joining device 16, for example using a clamp 17, they are joined to one another and thus the connection 11 is produced.

Step 5: Then, the clamping devices 8 and 10 are released.

Step 6: Using a drive that is provided in, for example, the applicator head 12, the first spacer 1 is moved forward and in doing so entrains the second spacer 2 that is now joined to it.

Step 7: The separating process in the first spacer 1 that ends the application of the first spacer 1 to the workpiece 22, 23 (the old spacer 1 is applied to the latter) is undertaken such that the separation site, relative to the feed direction of the spacers 1 and 2, is upstream from the joining site 11.

Step 8: The connection 11 between the first (old) spacer 1 and second (new) spacer 2 is conveyed by the applicator head 12.

Step 9: Relative to the feed direction of the spacers 1 and 2, downstream from the connection 11 on the exit end of the applicator head 12, a separating cut is made so that a new, free start of the second (new) spacer 2 is ready for application to a workpiece 22, 23, for example a pane of glass, for example when insulating glass is being produced.

Step 10: The piece of scrap that bears the connection 11, therefore the piece that contains the old and new spacers 1 and 2 between the separating cut after step 7 and the separating cut after step 9, is ejected.

In summary, one embodiment of the invention can be described as follows:

In a method and a device for preferably automated changing of spacers 1, 2 in a unit with at least one applicator head 12 for application of spacers 1, 2 to sheet-shaped workpieces 22, 23, especially panes of glass, spacers 1, 2 from at least two sources are supplied to the applicator head 12, staggered in time to one another. A first spacer 1 from a first source is severed. The resulting end 13 of the first spacer 1 and a start 14 of the second spacer 2 that comes from a second source are moved with a changing apparatus into a position assigned to one another. Then, the end 13 of the first spacer 1 is joined to the start 14 of the second spacer 2. A resulting connection 11 of the first spacer 1 to the second spacer 2 runs through the unit until the connection 11 has passed the applicator head 12. After the connection 11 has passed the applicator head 12, the second spacer 2 is severed in a region between the connection 11 and the applicator head 12.

The invention claimed is:

1. A method for changing spacers in a unit with at least one applicator head for application of spacers to sheet-shaped workpieces, the method comprising:

supplying the respective spacer from at least two sources to the applicator head staggered in time one to another;

severing a first spacer from a first one of the sources;

moving a resulting end of the first spacer and a start of a second one of the spacers from a second source with a changing apparatus into a position assigned to the resulting end of the first spacer and the start of the second spacer;

joining the end of the first spacer to the start of the second spacer;

running a resulting connection of the first and second spacers through the unit until the connection passes the applicator head; and after the connection passes the applicator head, severing the second spacer in a region between the connection and the applicator head.

2. The method according to claim 1, wherein the first spacer is severed after a removal device removes the first spacer of the first source.

3. The method according to claim 2, wherein each of the spacers that is located in the applicator head is severed after application in a region between the workpiece and the applicator head.

4. The method according to claim 1, wherein each of the spacers that is located in the applicator head is severed after application in a region between the workpiece and the applicator head.

5. The method according to claim 1, wherein the second spacer is severed after the connection passes the applicator head.

6. The method according to claim 1, wherein when different spacers are to be applied to successive workpieces, a length of the first spacer that is to be applied is computed based on dimensions of the workpiece or workpieces to be worked before the changing and the first spacer is severed on or after the computed end is connected to the second spacer.

7. The method according to claim 1, wherein the connection of the spacers is produced by pressing, by cementing and/or by at least one mechanical joining device.

8. The method according to claim 7, wherein the mechanical joining device is a clamp.

9. The method according to claim 1, wherein the end of the spacer formed by severing is held in place.

10. The method according to claim 9, wherein the end of the spacer is held in place by clamping the end.

11. The method according to claim 1, wherein the start of the second spacer for joining to the end of the first spacer is held in place in a position assigned to the end of the first spacer.

12. The method according to claim 11, wherein the start of the second spacer is held in place by clamping the start.

13. The method according to claim 1, wherein the sheet-shaped workpieces are panes of glass.

14. A device for changing spacers in a unit with at least one applicator head for application of spacers to sheet-shaped workpieces, the device comprising:

at least two sources for spacers;

a first separating device configured to separate spacers coming from the sources on a respective removal-clamping device;

a changing device having a changing-clamping device configured to move a separated part of one of the spacers assigned to the applicator head with the changing-clamping device from one of the removal-clamping devices to another of the removal-clamping devices; and an apparatus configured to join the end of the spacer assigned to the applicator head to a start of a second spacer, the start of the second spacer being held in one of the removal-clamping devices.

15. The device according to claim 14, further comprising an intermediate storage unit for spacers connected downstream from the changing device.

16. The device according to claim 15, wherein the intermediate storage unit is at least one dancer roll or sag control in a feed to the applicator head.

17. The device according to claim 16, further comprising a second separating device in the feed direction of one of the spacers downstream from the applicator head.

18. The device according to claim 15, further comprising a second separating device in the feed direction of one of the spacers downstream from the applicator head.

19. The device according to claim 14, further comprising a second separating device in a feed direction of one of the spacers downstream from the applicator head.

* * * * *